US006655689B1

(12) United States Patent
Stasi

(10) Patent No.: US 6,655,689 B1
(45) Date of Patent: Dec. 2, 2003

(54) CRAPS GAME IMPROVEMENT

(75) Inventor: Perry B. Stasi, 1260 Panini Dr., Henderson, NV (US) 89052

(73) Assignees: Perry B. Stasi, Henderson, NV (US); Peter D. Keefe, Roseville, MI (US)

( * ) Notice: Subject to any disclaimer, the term of this patent is extended or adjusted under 35 U.S.C. 154(b) by 0 days.

(21) Appl. No.: 10/090,132

(22) Filed: Feb. 28, 2002

(51) Int. Cl.[7] ..... A63F 9/04
(52) U.S. Cl. ..... 273/274
(58) Field of Search ..... 273/274, 309, 273/146

(56) References Cited

U.S. PATENT DOCUMENTS

| | | | | |
|---|---|---|---|---|
| D190,503 | S | | 6/1961 | Barron |
| 3,399,897 | A | | 9/1968 | Mitchel |
| D216,720 | S | | 3/1970 | Mitchell |
| 3,904,208 | A | | 9/1975 | Grossman |
| D250,054 | S | | 10/1978 | Crawford |
| D263,975 | S | | 4/1982 | Quiroga et al. |
| D266,859 | S | | 11/1982 | Skender |
| 4,688,803 | A | | 8/1987 | Ollington |
| 4,902,019 | A | | 2/1990 | Berman |
| 5,078,404 | A | | 1/1992 | Barillaro et al. |
| 5,288,081 | A | | 2/1994 | Breeding |
| D345,767 | S | | 4/1994 | Ollington |
| 5,308,081 | A | | 5/1994 | Bartle |
| D362,029 | S | | 9/1995 | Nelson |
| 5,487,547 | A | | 1/1996 | Hobert |
| 5,513,850 | A | | 5/1996 | Vancura |
| 5,513,851 | A | | 5/1996 | Harris |
| D372,940 | S | | 8/1996 | Ryan |
| 5,728,002 | A | | 3/1998 | Hobert |
| 5,788,240 | A | * | 8/1998 | Feinberg ..... 273/274 |
| 5,791,651 | A | * | 8/1998 | Bryant ..... 273/274 |
| D398,660 | S | | 9/1998 | Mollo et al. |
| 5,829,748 | A | | 11/1998 | Moore, Jr. |
| 5,829,749 | A | * | 11/1998 | Hobert |
| 5,931,471 | A | * | 8/1999 | Bonito ..... 273/274 |
| 5,964,463 | A | * | 10/1999 | Moore, Jr. ..... 273/274 |
| 6,019,374 | A | | 2/2000 | Breeding |
| 6,213,876 | B1 | | 4/2001 | Moore, Jr. |
| D454,375 | S | | 3/2002 | Ryan et al. |
| 6,464,225 | B1 | * | 10/2002 | Webb ..... 273/274 |
| 2001/0028147 | A1 | * | 10/2001 | Ornstein et al. |
| 2001/0034264 | A1 | | 10/2001 | Berman et al. |

OTHER PUBLICATIONS

Craps Table Layout in Public Use by Inventor P.B. Stasi Since Dec. 18, 1999 at Motor City Casino, Detroit, MI.

"Ask Mr. Craps" Overview of Craps Rules and Bets, 32 Pages, Internet Website; www.askmrcraps.com. Dated 2001.

* cited by examiner

*Primary Examiner*—William M. Pierce
(74) *Attorney, Agent, or Firm*—Peter D. Keefe

(57) ABSTRACT

A proposition bet for Craps referred to as a FIRE BET™. The method includes predetermining a schedule of a pay-out table, players placing FIRE BET wagers at respective player betting areas prior to a shooter's initial come out; accumulating points responsive to outcomes of the shooter's dice throws, wherein points are made when a number 4, 5, 6, 8, 9 or 10 is twice rolled before sevening out, and wherein repeating of any made number is ignored, and making a pay-out based upon the points accumulated and the schedule.

18 Claims, 7 Drawing Sheets

Fig. 5
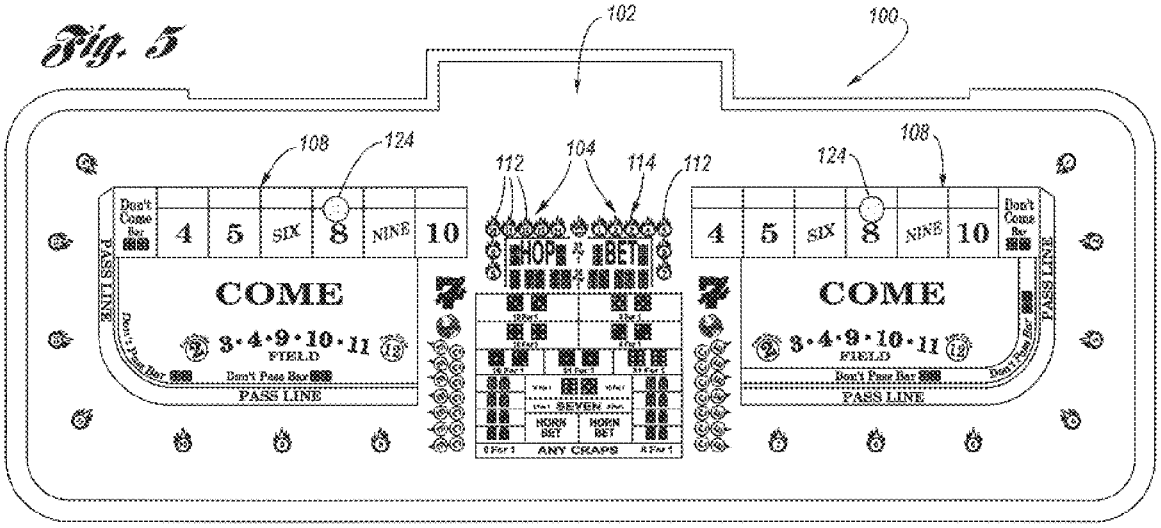
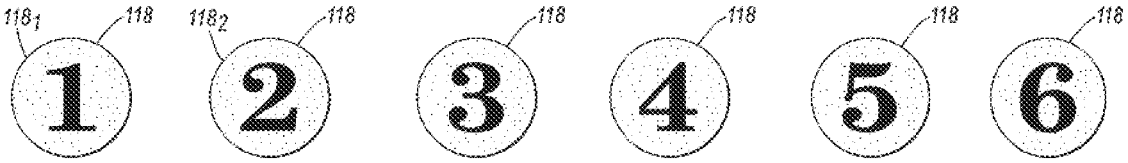
Fig. 6A Fig. 6B Fig. 6C Fig. 6D Fig. 6E Fig. 6F

CRAPS GAME IMPROVEMENT

BACKGROUND OF THE INVENTION

1. Field of the Invention

The present invention relates to a well known wagering game called "Craps" and more particularly to an improvement thereto referred to herein as a "FIRE BET™".

2. Description of the Prior Art

Craps is a casino wagering game which is enjoyed for its fast pace and excitement. The standard rules of play for Craps are very well established, so that there is no need to inform those having ordinary skill in the art how Craps is played. However, as a prelude to discussion of the present invention, it is useful to provide a short overview of the standard rules pertaining to a Craps "Pass Line" bet.

Referring now to FIG. 1, Craps is played on an elongated Craps table 10, having a horizontal table top 12 surrounded by a sidewall 14. The playing surface 16 is provided with a lay-out 18 in the form of indicia indicative of the play of Craps. The playing surface 16, may for example be a felt material having the indicia of the lay-out 18 imprinted thereupon. The lay-out 18 includes indicia indicative of a pass line bet area 20, indicia indicative of a point number area 22 (a plurality of squares having, respectively, therein the numbers 4, 5, 6, 8, 9 and 10), and indicia indicative of a proposition bet area 24.

In the play of Craps according to the standard rules, every player gets a chance to throw the dice. The person throwing the dice is called the "shooter". The shooter must make a "pass line" (referred to also as a "line") wager (bet) by placing a selected number of chips representing the value of the wager within the pass line bet area 20. The shooter then throws the dice for his or her initial toss, referred to as the "initial come out". If a 7 or an 11 was thrown, then a Pass Line wager wins and is paid even money; this outcome is referred to as a "natural winner". If a 2, 3, or 12 was thrown, then a pass line wager loses and is forfeited; this outcome is referred to as a "natural loser". If a number is thrown other than a 2, 3, 7, 11, or 12, then that number establishes the shooter's "point" (this point is either a 4, 5, 6, 8, 9, or 10). The shooter's point is then marked by a dealer with a white circular point marker 26 called a "puck" (in FIG. 1, the puck is placed by way of example on the 5 number because the shooter has, merely by way of example, tossed a number 5).

Once a point has been established, the shooter will continue to throw (that is, roll or toss) the dice until he or she either: 1) throws the point number again (referred to as "making the point"), or 2) throws a 7 (referred to as a "seven out" or "sevening out"). If the shooter "makes the point", then any player who made a pass line wager wins even money, and the shooter throws the dice for a repeat come out (this toss is not to be confused with the "initial come out"). If, however, the shooter "seven outs", then any player who made a pass line wager forfeits the money wagered, and the shooter forfeits his or her turn and passes the right to dice throwing to the next shooter (in clockwise order). This next shooter will then throw an initial come out after bets have been placed, as described hereinabove. While the game of craps played according to the standard rules is exciting and enjoyable to play, what remains needed in the art is an improvement in the form of a simply executed proposition wager which provides the bettor the possibility of a high pay-out relative to the value of the bet.

SUMMARY OF THE INVENTION

The present invention is an improvement to the standard rules of craps in the form of a simply executed proposition wager which provides the bettor the possibility of a high pay-out relative to the value of the bet, referred to hereinafter as a "FIRE BET™".

A FIRE BET is a proposition bet made in conjunction with a Craps game otherwise played according to conventional rules of play. The lay-out is modified to include sequentially labeled wager areas located in the center of the Craps lay-out near the customary proposition bet area, as well as to include a plurality of mutually spaced player betting areas located in front of each player position around the Craps lay-out. The betting areas are sequentially labeled around the lay-out in correspondence with the sequential labeling of the wager areas. A plurality of point markers are provided for selective placement at the point number area as points are made according to the method of the present invention. The outcome of a FIRE BET wager is determined according to the method of the present invention and is dependent upon the course of play of the Craps game, wherein all other wagers under conventional rules are independent of whether or not a FIRE BET is wagered.

A player can only make a FIRE BET wager before the initial come out dice toss of each shooter. Each player making a FIRE BET wager must do so by making a FIRE BET wager indication by placing his or her chip(s) on the appropriate player wager area on the lay-out directly below their gaming position. Once a FIRE BET is wagered by placement of at least one selected chip at each participating player's respective player betting area, a dealer will retrieve the chip(s) and place the chip(s) upon the corresponding wager areas, designated for a "FIRE BET" in the proposition area. These FIRE BET wagers will then remain in the respective wager areas until the FIRE BET wagers are paid or lost, wherein FIRE BET wagers are won or lost based upon accumulation of "made points" in response to outcomes of dice throws by the shooter.

The shooter throws his or her initial come out toss. If the outcome is a natural winner or looser, there is no affect upon accumulation of made points, and, in this scenario, a shooter then repeats an initial come out throw. If the initial come out toss result is a point (a number 4, 5, 6, 8, 9, or 10) then the point is established, and the puck is placed at the point location of the point number area. The shooter then again tosses the dice. If the outcome is the point, then the point is made, the puck is removed and a selected point marker is placed at the point location of the point number area a point marker is placed. The shooter then continues to toss the dice. Additional points are accumulated in the same manner only if the outcome is a new point not already made. At any time during the course of play, if the outcome is a seven out the game is over.

A pay-out to the FIRE BET wagerers is won according to the schedule of a predetermined pay-out table. For example, a pay-out may require accumulation of 3 points, wherein if the game ends at an accumulated 0, 1 or 2 points, then the FIRE BET wager is lost; but, if 3 points are accumulated, then a pay-out is won according to the schedule of the pay-out table. In this example, if the game ended at the accumulation of points higher than 3, then the pay-out won is that only of the points of the highest accumulated points according to the schedule of the pay-out table.

Accordingly, it is an object of the present invention to provide an improved Craps game having a simply executed proposition wager which provides the bettor the possibility of a high pay-out relative to the bet.

This, and additional objects, advantages, features and benefits of the present invention will become apparent from the following specification.

BRIEF DESCRIPTION OF THE DRAWINGS

FIG. 5 is a top plan view of the Craps table and lay-out of FIG. 2, shown in operation according to the method of the present invention.

FIGS. 6A through 6L are top plan views of point markers according to the present invention.

DETAILED DESCRIPTION OF THE PREFERRED EMBODIMENT

Figure 1:
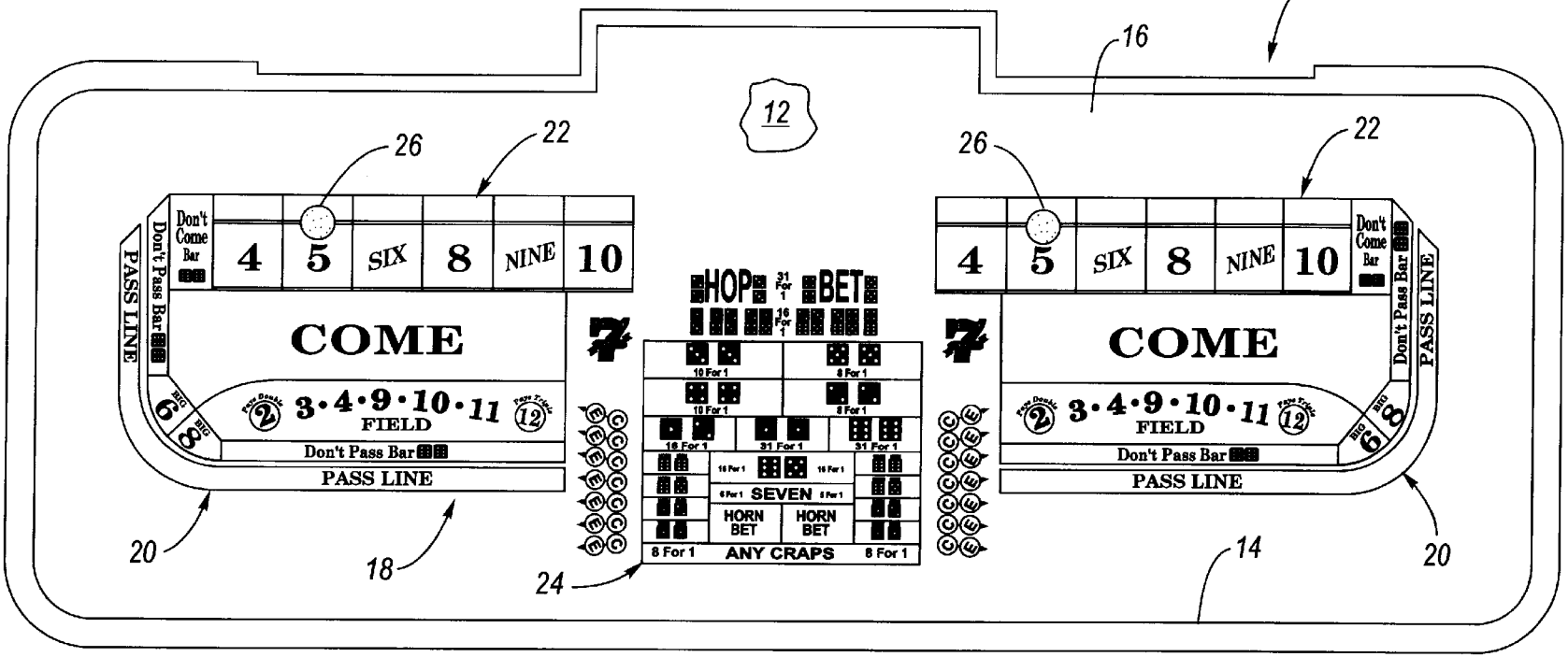
Prior Art Fig. 1
FIG. 1 is a top plan view of a prior art Craps table and lay-out.
Figure 2:
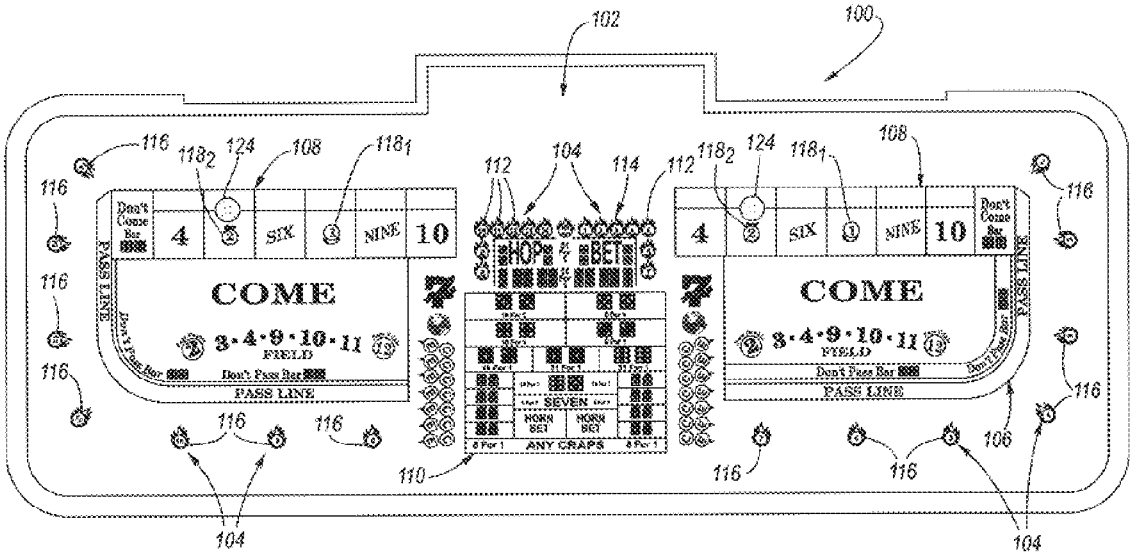
FIG. 2 is a top plan view of a Craps table and lay-out incorporating a FIRE BET according to the present invention.

Referring now to the Drawing, FIGS. 2 through 7B depict various aspects of the present invention, wherein FIG. 2 shows a plan view of a Craps table 100 having a Craps lay-out 102 including FIRE BET™ indicia 104 according to the present invention. The Craps table 100 is structurally conventional. The lay-out 102 includes conventional wager indicia pertaining to all conventional Craps wagers, including indicia indicative of a pass line bet area 106, indicia indicative of a point number area 108 (a plurality of squares having therein, respectively, numbers 4, 5, 6, 8, 9 and 10), and indicia indicative of a proposition bet area 110.

In addition to the aforesaid conventional wager indicia, the lay-out 102 has, as above mentioned, FIRE BET indicia 104. In this regard, a plurality of sequentially labeled FIRE BET wager areas 112 are located in a FIRE BET wager area 114 at the center of the lay-out 102 near the proposition bet area 110, and a plurality of mutually spaced FIRE BET player betting areas 116 are located in front of each player position, respectively, around the lay-out. The FIRE BET player betting areas 116 are sequentially labeled in clockwise rotation around the lay-out 102, wherein the labeling is in one-to-one correspondence with the sequential labeling of the FIRE BET wager areas 112. In the preferred embodiment, both the FIRE BET wager areas 112 and the FIRE BET player betting areas 116 are circles, 14 in number, having numeric labeling beginning with 1 and ending with 14.

As shown at FIGS. 6A through 6E, a plurality of point markers 118 are provided for selective placement at the point number area 108 as points are made according to the method of the present invention. It is preferred for the point markers 118 to be indicative of the accumulated points, respectively. In this regard, it is preferred for the point markers 118 to have indicia identifiably specific to the point accumulation, such as point number indicia, as indicated at FIGS. 6A through 6F. Also in this regard, it is preferred for the point markers 118 to have indicia which is identifiably specific to the accumulated points pay-out amount based upon, for example, a $2.50 bet and the schedule of the pay-out table, as exemplified by FIGS. 6G through 6L (which embodiments are most preferred), wherein point marker $\mathbf{118}_1'$ indicates no pay-out (since only a first point has been made), and wherein point markers $\mathbf{118}_2$, $\mathbf{118}_3$, $\mathbf{118}_4$, $\mathbf{118}_5$ and $\mathbf{118}_6$ are associated with accumulated points per the schedule of the pay-out table, for example 2, 3, 4, 5 and 6 accumulated made points, respectively. It is further preferred for the point markers to be clearly different from both the chips and the puck, as for example being a unique color and unique size intermediate of that the puck and chips. It is preferred that during play each point marker of each made point be displayed so as to avoid confusion over which point numbers have already been made. For example, if 1 point has been made, then the point marker indicative of 1 point is displayed. Subsequently, if 2 points are made, then the point marker indicative of 1 point remains and a point marker indicative of 2 points is also displayed.

It is to be noted that the indication of points made may be by any mechanism or device, be that puck-like point markers (as shown at FIGS. 6A through 6L), or by some other apparatus, such as for example an electronic indication. For example, there may be a point marker light embeded in the table and visible through the lay-out at each point number of the point number area, wherein any light may display any of the accumulated points indicia. In this example, a dealer presses a selected button switch to illuminate a point marker light, wherein the display is indicative of the accumulated made points. Alternatively, for example, rather than a light, or in addition thereto, a screen may electronically display the point marker information. In this electronic form of point markers, the dealer would choose to activate a light, display etc. appropriate to the points made via selection of a switch from a plurality of switches or by other electronic data entry device.

The outcome of a FIRE BET wager is determined according to the method of the present invention and is dependent upon the course of play of the Craps game, wherein all other wagers under conventional rules are independent of whether or not a FIRE BET is wagered.

Figure 3:
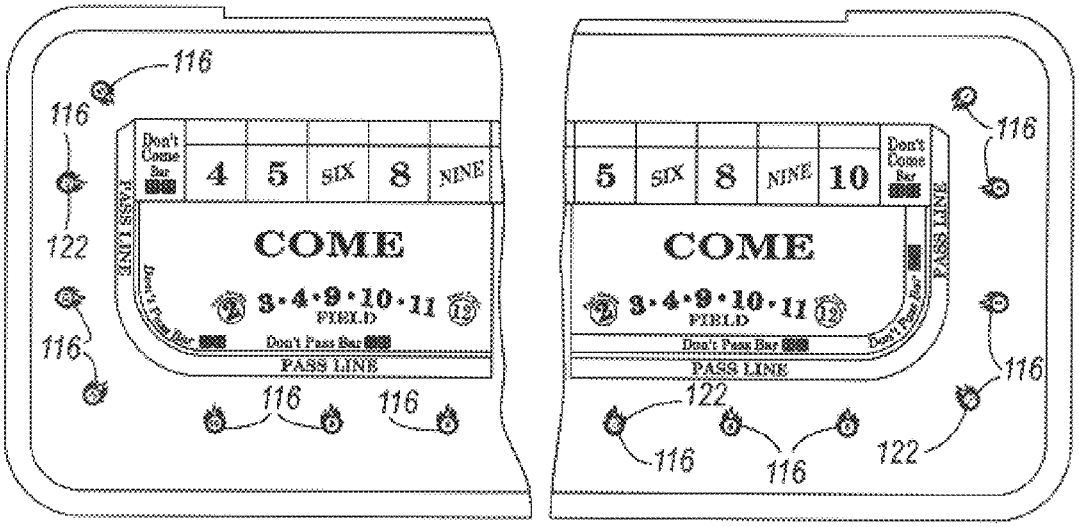
FIG. 3 is a broken-away top plan first view of the Craps table and lay-out of FIG. 2, shown in operation according to the method of the present invention.

According to the preferred method of the present invention, any player may make a FIRE BET wager, either by itself or independently accompanying a conventional Craps wager, wherein the player can only make a FIRE BET wager before the initial come out dice toss of each shooter. Each player making a FIRE BET wager must do so by making a FIRE BET wager indication by placing his or her chip(s) 120 on the appropriate FIRE BET player betting area 116 on the lay-out 102 directly below his or her respective gaming position. For example, FIG. 3 depicts FIRE BET wagers made by three players who placed their chips 120 at their respective player position FIRE BET player betting area 116 (any independently accompanying conventional Craps bet these players may have also made is not shown for simplicity). While the FIRE BET wager indication placed by a player at his or her respective FIRE BET betting area 116 may be any chip, it is preferred for the FIRE BET wager indication to be a unique FIRE BET chip having a predesignated value, preferably having a $2.50 value.

Figure 4:
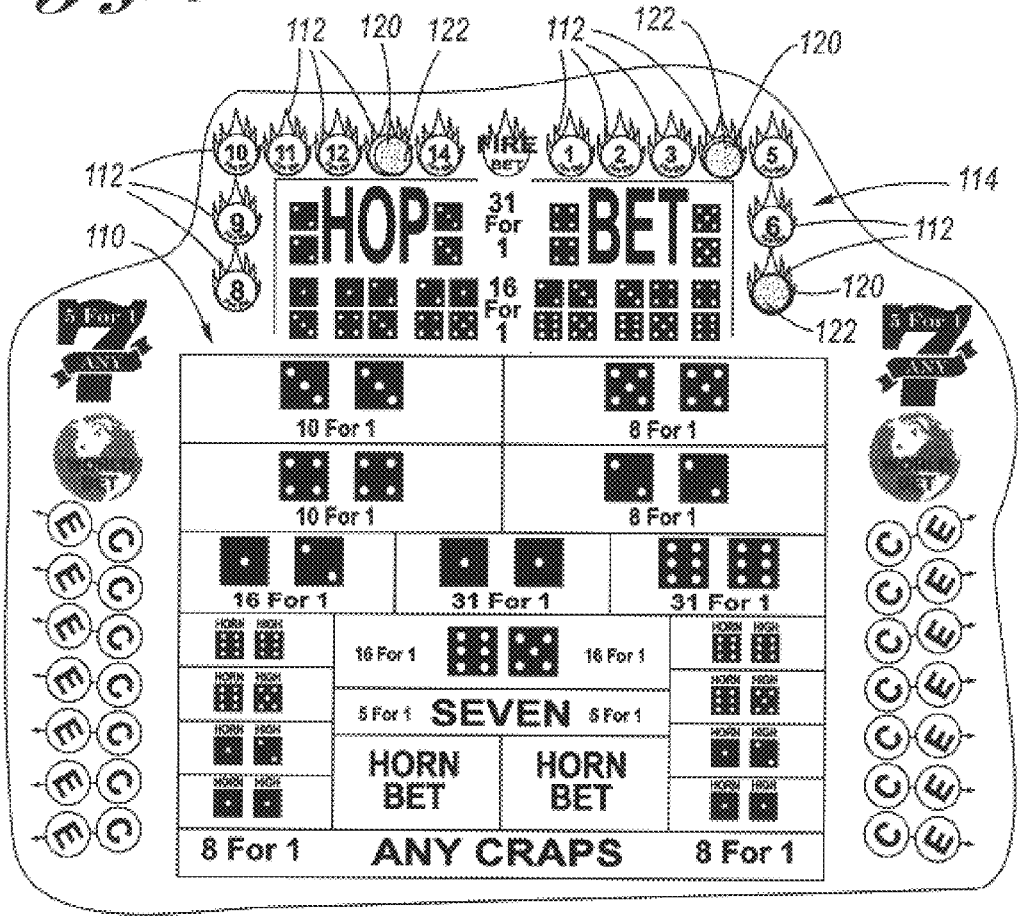
FIG. 4 is a broken-away top plan second view of the Craps table and lay-out of FIG. 2, shown in operation according to the method of the present invention.
Figure 6G:
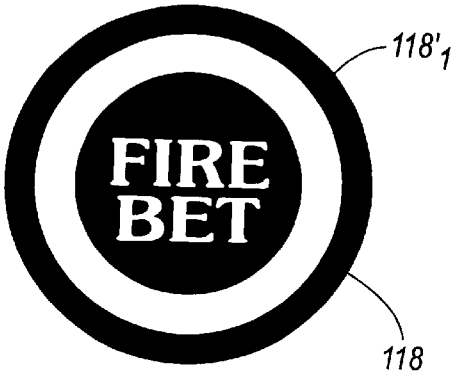
Figure 6H:
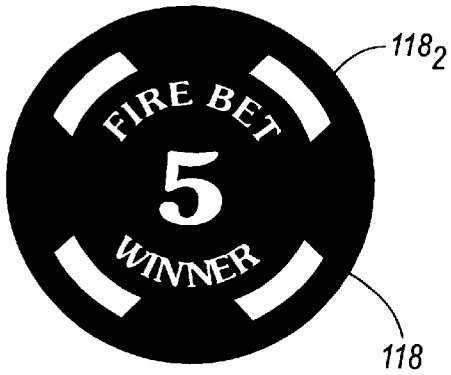
Figure 6I:
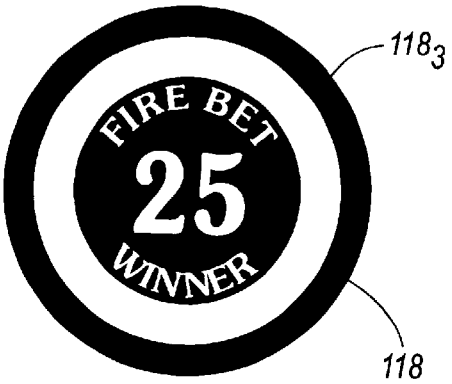
Figure 6J:
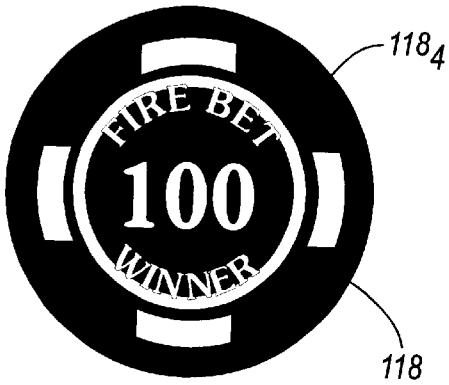
Figure 6K:
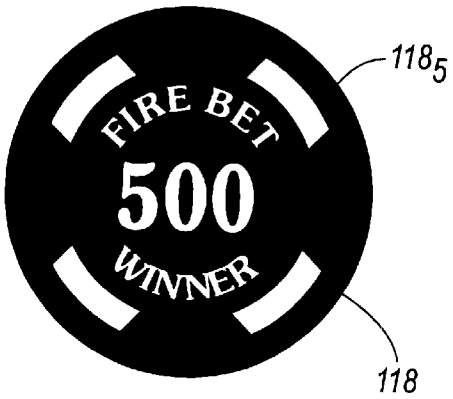
Figure 6L:
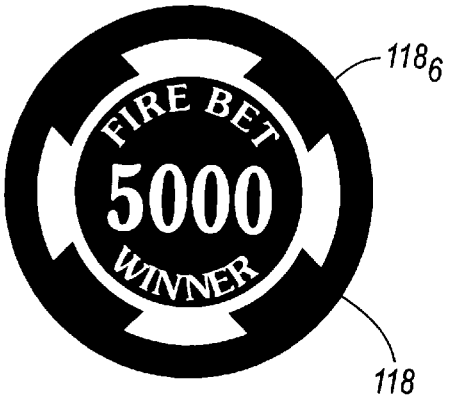

Once a FIRE BET is wagered, a dealer will retrieve the chip(s) 120 and place the chip(s) upon the corresponding FIRE BET wager areas 112 of the FIRE BET wager area 114 adjacent the proposition area 110 (see FIG. 4). These FIRE BET wagers 122 will then remain in the respective FIRE BET wager areas 112 until the FIRE BET wagers are either paid or lost. In this regard, FIRE BET wagers are won or lost based upon accumulation of "made points" in response to outcomes of dice throws by the shooter. In this regard, each successive made point is a numerical non-repeat made point of all earlier made points. The accumulated number of made points is the FIRE BET player's "made points" or simply, "points". Whether a loss (forfeit) or a pay-out occurs depends upon the number of points accumulated at the time the game ends based upon the schedule of a pay-out table.

Figure 7A:
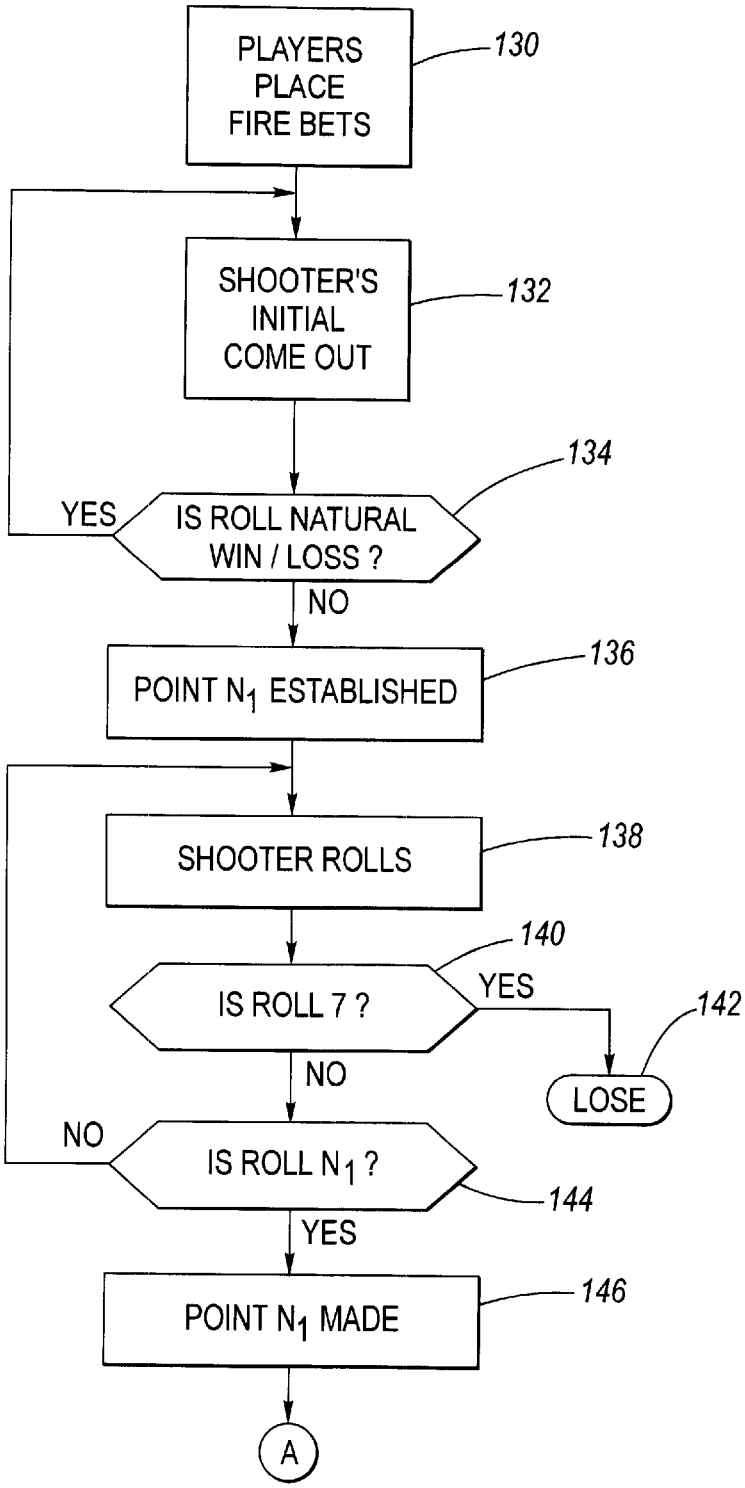
FIGS. 7A and 7B are a flow chart expositive of the method according to the present invention.
Figure 7B:
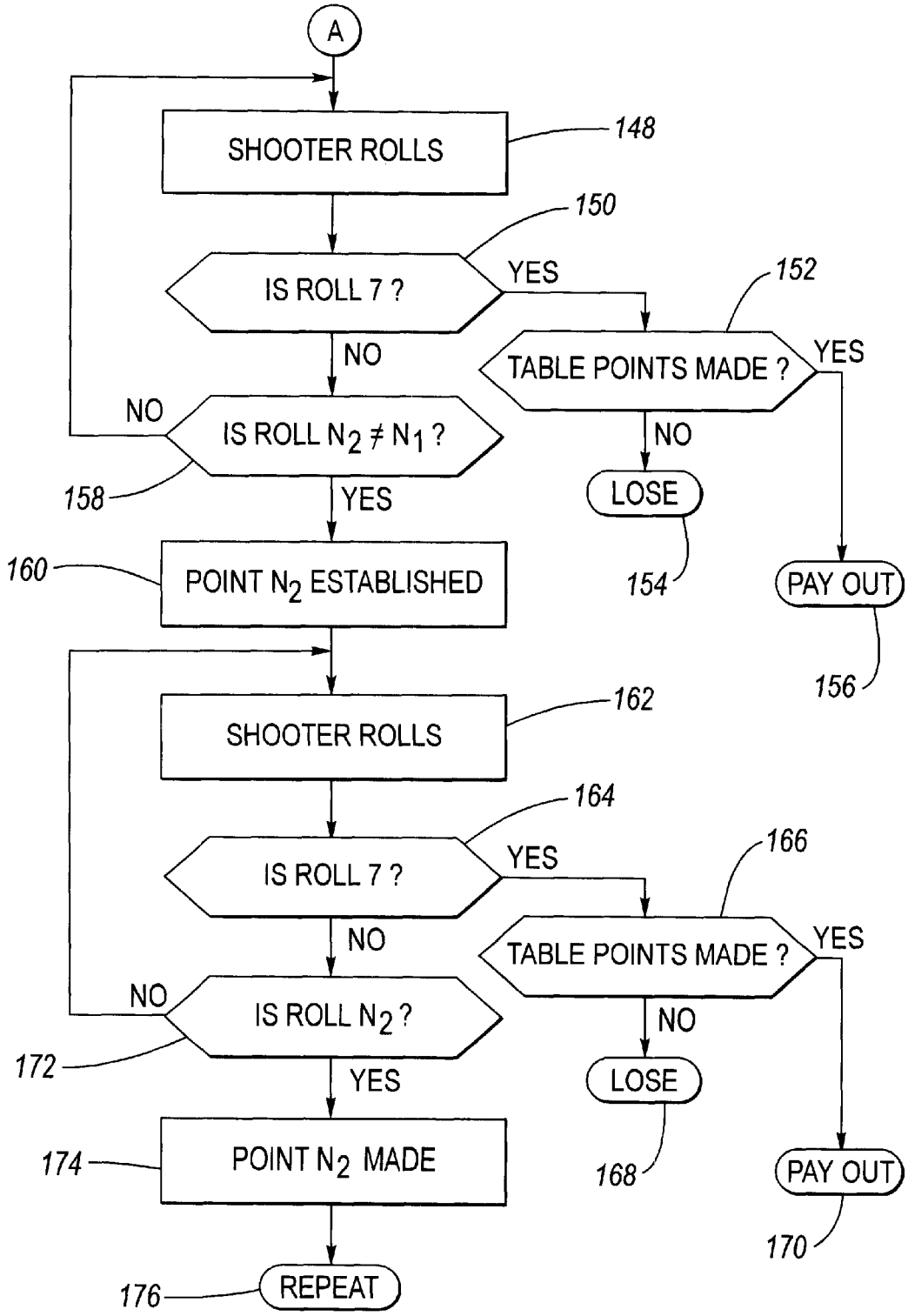

Referring now in particular to FIGS. 7A and 7B, the methodology of play according to the present invention will now be detailed.

Execution block 130 represents the FIRE BET players placing their respective FIRE BET wagers according to the aforesaid methodology. Thereafter, as represented by execution block 132, the shooter throws his or her initial come out toss. As represented by decision block 134, if the outcome is a natural winner or looser, then there is no affect upon accumulation of made points, and, in this scenario, the course of play returns to execution block 132, whereat a shooter repeats an initial come out throw. However, again referring to decision block 134, if the initial come out toss result is a point (a number 4, 5, 6, 8, 9, or 10) then, as represented by execution block 136, a point $N_1$ is established, wherein $N_1$ is any one of 4, 5, 6, 8, 9 or 10. The puck is then placed by a dealer at the point location corresponding to $N_1$ of the point number area 108. For example with reference to FIG. 5, the puck 124 has been placed at numeral 8 because a number 8 was rolled (that is, in this scenario $N_1$=8).

As represented by execution block 138, the shooter then again tosses the dice. If the outcome, as represented by decision block 140, is a number 7, then the shooter has sevened out and the FIRE BET wager is lost (forfeited), as represented by block 142. If not, then, as represented by decision block 144, if the outcome is the point (that is, the result equals $N_1$), then, as represented by execution block 146, the first point is made, and the FIRE BET players now have one made point (or simply, one point). Simultaneously, the puck is removed by a dealer, and a selected point marker $\mathbf{118}_1$ is placed at the point location of the point number $N_1$ (ie., point number 8) of the point number area 108 (see FIG. 2). Revisiting decision block 144, if, however, the outcome is other than the point, the shooter again rolls the dice, as represented by a return to execution block 138.

As represented by execution block 148, the shooter then again tosses the dice. As represented by decision block 150, if the outcome is a number 7, then the shooter has sevened out and the FIRE BET wager, as represented by decision block 152, is either lost (forfeited), as represented by execution block 154, or is won, as represented by execution block 156. In this regard, a pay-out is won if the number of points made is at least equal to a preset number of made points (or simply, points) according to a schedule of a pay-out table, as exemplified by Pay-Out Tables A through I hereinbelow. Further in this regard, it is preferred that no pay-out be won for accumulation of just a single made point (or point). If the outcome is not a 7, then, as represented by decision block 158, if the outcome is a point (that is, the result is $N_2$ wherein $N_2$ is anyone of 4, 5, 6, 8, 9 or 10 and $N_2 \neq N_1$), then, as represented by execution block 160 the point is established. The puck is then placed by a dealer at the point location corresponding to $N_2$ of the point number area in the manner aforesaid. Revisiting decision block 158, if, however, the outcome is other than the point, the shooter again rolls the dice, as represented by a return to execution block 148.

The shooter, as represented by execution block 162, again tosses the dice. As represented by decision block 164, if the outcome is a number 7, then the shooter sevens out and the FIRE BET wager, as represented by decision block 166, is either lost (forfeited), as represented by execution block 168, or is won, as represented by execution block 170. As mentioned above, a pay-out is made if the number of points made is at least equal to a preset number of made points (or points) according to a schedule of a pay-out table, as exemplified by Pay-Out Tables A through I hereinbelow. For example, if according to the schedule a minimum number of points is 3, then in this situation of play all FIRE BET wagers are lost; and, even if according to the schedule the minimum number of points is 2, still no pay-out is won because in this situation of play the second point has only been established, but has not yet been made. If the outcome is not a 7, then, as represented by decision block 172, if the outcome is the point (that is, the result is $N_2$), then, as represented by execution block 174 the second point is made, and the FIRE BET players now have two made points (or two points). The puck is then removed by a dealer, and, with the first point marker remaining at the point number $N_1$, a second selected point marker is placed at the point location of point number $N_2$ of the point number area, as aforedescribed. For example with reference again to FIG. 2, the puck 124 was placed at point number 5 (because this was, in this example, the point number established), and since this point number has now been made, the puck will be removed and the second selected point marker $\mathbf{118}_2$ has been placed thereat. Revisiting decision block 172, if, however, the outcome is other than the point, the shooter again rolls the dice, as represented by a return to execution block 162.

With the second point made, the methodology of play continues in the manner hereinabove described, as represented by execution block 176. In this regard, the third point is established when $N_3$ is rolled before a 7 is rolled, wherein $N_3$ is any one of 4, 5, 6, 8, 9 or 10 and $N_3 \neq N_1 \neq N_2$, and wherein the third point is made when $N_3$ is again rolled before a 7 is rolled; the fourth point is established when $N_4$ is rolled before a 7 is rolled, wherein $N_4$ is any one of 4, 5, 6, 8, 9 or 10 and $N_4 \neq N_1 \neq N_2 \neq N_3$, and wherein the fourth point is made when $N_4$ is again rolled before a 7 is rolled; the fifth point is established when $N_5$ is rolled before a 7 is rolled, wherein $N_5$ is any one of 4, 5, 6, 8, 9 or 10 and $N_5 \neq N_1 \neq N_2 \neq N_3 \neq N_4$, and wherein the fifth point is made when $N_5$ is again rolled before a 7 is rolled; and finally, the sixth point is established when $N_6$ is rolled before a 7 is rolled, wherein $N_6$ is any one of 4, 5, 6, 8, 9 or 10 and $N_6 \neq N_1 \neq N_2 \neq N_3 \neq N_4 \neq N_5$, and wherein the sixth point is made when $N_6$ is again rolled before a 7 is rolled.

The schedule of a predetermined pay-out table is critical information prior to play because: 1) it specifies the minimum number of points for a pay-out (any lesser number of points results in a loss (forfeit) of the FIRE BET wager), wherein only the pay-out corresponding to the accumulated point is paid out (all pay-outs for lesser point numbers are not paid); 2) it specifies the pay-out odds, and, consequently the pay-out per the accumulated points; and 3) it inherently defines the house odds edge.

Pay-Out Tables A through I define preferred pay-out schedules, Pay-Out Table I being most preferred. An exact probability analysis was performed to derive the probability distribution of all points made, The accuracy of the analysis was verified by a one-billion roll computer simulation. In that a shooter could, in theory, have an infinitely long streak of making points without sevening out, approximations were made. However, the error is estimated to be within an insignificant 0.000002%.

Pay-Out Table A
(House edge: 17.12%)

| Number of points made: | Pay-out odds: | Probability: |
|---|---|---|
| 6 points | 2,000 for 1 | 0.0162435 |
| 5 points | 200 for 1 | 0.163993 |
| 4 points | 20 for 1 | 0.879818 |

Pay-Out Table B
(House edge: 24.16%)

| Number of points made: | Pay-out odds: | Probability: |
|---|---|---|
| 6 points | 2,000 for 1 | 0.0162435 |
| 5 points | 200 for 1 | 0.163993 |
| 4 points | 12 for 1 | 0.879818 |

Pay-Out Table C
(House edge: 19.39%)

| Number of points made: | Pay-out odds: | Probability: |
|---|---|---|
| 6 points | 3,000 for 1 | 0.0162435 |
| 5 points | 100 for 1 | 0.163993 |
| 4 points | 10 for 1 | 0.879818 |
| 3 points | 2 for 1 | 3.343420 |

Pay-Out Table D
(House edge: 19.99%)

| Number of points made: | Pay-out odds: | Probability: |
|---|---|---|
| 6 points | 1,000 for 1 | 0.0162435 |
| 5 points | 200 for 1 | 0.163993 |
| 4 points | 20 for 1 | 0.879818 |
| 3 points | 4 for 1 | 3.343420 |

Pay-Out Table E
(House edge: 15.39%)

| Number of points made: | Pay-out odds: | Probability: |
|---|---|---|
| 5 points | 200 for 1 | 0.180237 |
| 4 points | 40 for 1 | 0.879818 |
| 3 points | 4 for 1 | 3.343420 |

Pay-Out Table F
(House edge: 14.34%)

| Number of points made: | Pay-out odds: | Probability: |
|---|---|---|
| 5 points | 280 for 1 | 0.180237 |
| 4 points | 40 for 1 | 0.879818 |

Pay-Out Table G
(House edge: 22.07%)

| Number of points made: | Pay-out odds: | Probability: |
|---|---|---|
| 5 points | 200 for 1 | 0.180237 |
| 4 points | 40 for 1 | 0.879818 |
| 3 points | 2 for 1 | 3.343420 |

Pay-Out Table H
(House edge: 21.55%)

| Number of points made: | Pay-out odds: | Probability: |
|---|---|---|
| 5 points | 240 for 1 | 0.180237 |
| 4 points | 40 for 1 | 0.879818 |

Pay-Out Table I
(House edge: 24.87%)

| Number of points made: | Pay-out odds: | Probability: |
|---|---|---|
| 6 points | 1,999 for 1 | 0.0162435 |
| 5 points | 200 for 1 | 0.163993 |
| 4 points | 10 for 1 | 0.879818 |

It is to be understood that by the term "shooter" means a person or persons who shoot from an initial come out to a seven out. In that the person who is serving as the shooter may leave the game in mid-play, any player who serves thereupon in substitution as shooter in his or her place is included by, and within the meaning of, the term shooter.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. In a game of Craps comprising:

dice; and a table having a playing surface provided with a lay-out including indicia indicative of a pass line bet area for making pass line bets, and indicia indicative of a point number area displaying numbers 4, 5, 6, 8, 9 and 10; wherein play of the game of Craps comprises the steps of:

a shooter making a pass line bet at the pass line bet area; and the shooter throwing the dice onto the lay-out for an initial come out of the shooter, wherein if a 7 or an 11 of the dice is thrown, then the pass line bet wins, and wherein if a 2, 3, or 12 of the dice is thrown, then the pass line bet loses, and wherein if a number of the dice is thrown other than a 2, 3, 7, 11, or 12, then that number establishes a point number, wherein once the point number has been established, then the shooter will continue to throw the dice until the shooter either again throws the point number of the dice which thereby makes a made point and allows the shooter to again throw the dice for a repeat come out, or throws a 7 of the dice resulting in a sevening out and the shooter forfeiting throwing of the dice; an improvement thereto comprising a method for playing a proposition bet for the game of Craps, said method comprising the steps of:

predetermining a schedule of a pay-out table for the proposition bet;

at least one player placing a wager indication of the proposition bet prior to a shooter's initial come out;

accumulating made points responsive to outcomes of the shooter's dice throws, said made points being made when a number of the dice from the number group 4, 5, 6, 8, 9 and 10 is the outcome of any two of the shooter's dice throws prior to a sevening out, and wherein repetition of a number of any previously made point is ignored; and winning a pay-out based upon the made points accumulated and the schedule.

2. The method of claim 1, wherein said step of accumulating made points comprises:

establishing a first point number if any of the shooter's dice throw outcomes is a number $N_1$ equal to any one of a 4, 5, 6, 8, 9, and 10 prior to sevening out; and making a first made point if thereafter any of the shooter dice throw outcomes is again the number $N_1$ prior to sevening out;

wherein after said step of making the first made point, providing a first indicator indicative of the first made point having been made.

3. The method of claim 2, wherein said step of providing a first indicator comprises placing a first point marker at the number $N_1$ of the point number area of the lay-out.

4. The method of claim 2, wherein said step of accumulating made points further comprises:

establishing a second point number if any of the shooter's dice throw outcomes is a number $N_2$ equal to any one of a 4, 5, 6, 8, 9, and 10 and $N_2 \neq N_1$ prior to sevening out; and making a second made point if thereafter any of the shooter dice throw outcomes is again the number $N_2$ prior to sevening out;

wherein after said step of making the second made point, providing a second indicator indicative of the second made point having been made.

5. The method of claim 4, wherein said step of providing a second indicator comprises placing a second point marker at the number $N_2$ of the point number area of the lay-out.

6. The method of claim 4, wherein said step of accumulating made points further comprises:

establishing a third point number if any of the shooter's dice throw outcomes is a number $N_3$ equal to any one of a 4, 5, 6, 8, 9, and 10 and $N_3 \neq N_1 \neq N_2$ prior to sevening out; and making a third made point if thereafter any of the shooter dice throw outcomes is again the number $N_3$ prior to sevening out;

wherein after said step of making the third made point, providing a third indicator indicative of the third made point having been made.

7. The method of claim 6, wherein said step of providing a third indicator comprises placing a third point marker at the number $N_3$ of the point number area of the lay-out.

8. The method of claim 6, wherein said step of made accumulating points further comprises:

establishing a fourth point number if any of the shooter's dice throw outcomes is a number $N_4$ equal to any one of a 4, 5, 6, 8, 9, and 10 and $N_4 \neq N_1 \neq N_2 \neq N_3$ prior to sevening out; and making a fourth made point if thereafter any of the shooter dice throw outcomes is again the number $N_4$ prior to sevening out;

wherein after said step of making the fourth made point, providing a fourth indicator indicative of the fourth made point-having been made.

9. The method of claim 8, wherein said step of providing a fourth indicator comprises placing a fourth point marker at the number $N_4$ of the point number area of the lay-out.

10. The method of claim 8, wherein said step of accumulating made points further comprises:

establishing a fifth point number if any of the shooter's dice throw outcomes is a number $N_5$ equal to any one of a 4, 5, 6, 8, 9, and 10 and $N_5 \neq N_1 \neq N_2 \neq N_3 \neq N_4$ prior to sevening out; and making a fifth made point if thereafter any of the shooter dice throw outcomes is again the number $N_5$ prior to sevening out; and wherein after said step of making the fifth made point, providing a fifth indicator indicative of the fifth made point having been made.

11. The method of claim 10, wherein said step of providing a fifth indicator comprises placing a fifth point marker at the number $N_5$ of the point number area of the lay-out.

12. The method of claim 10, wherein said step of accumulating made points further comprises:

establishing a sixth point number if any of the shooter's dice throw outcomes is a number $N_6$ equal to any one of a 4, 5, 6, 8, 9, and 10 and $N_6 \neq N_1 \neq N_2 \neq N_3 \neq N_4 \neq N_5$ prior to sevening out; and making a sixth made point if thereafter any of the shooter dice throw outcomes is again the number $N_6$ prior to sevening out; and wherein after said step of making the sixth made point, providing a sixth indicator indicative of the sixth made point having been made.

13. The method of claim 12, wherein said step of providing a sixth indicator comprises placing a sixth point marker at the number $N_6$ of the point number area of the lay-out.

14. The method of any of claims 1, 2, 4, 6, 8, 10 and 12, wherein the lay-out further includes indicia of a player betting area and a wager area corresponding to the player betting area, wherein said step of placing comprises:

the at least one player placing the wager indication of the proposition bet at the player betting area of the lay-out; and a dealer placing the wager indication at the corresponding wager area of the lay-out.

15. In a game of Craps comprising:

dice; and a table having a playing surface provided with a lay-out including indicia indicative of a pass line bet area for making pass line bets, and indicia indicative of a point number area displaying numbers 4, 5, 6, 8, 9 and 10; wherein play of the game of Craps comprises the steps of:

a shooter making a pass line bet at the pass line bet area; and the shooter throwing the dice onto the lay-out for an initial come out of the shooter, wherein if a 7 or an 11 of the dice is thrown, then the pass line bet wins, and wherein if a 2, 3, or 12 of the dice is thrown, then the pass line bet loses, and wherein if a number of the dice is thrown other than a 2, 3, 7, 11, or 12, then that number establishes a point number, wherein once the point number has been established, then the shooter will continue to throw the dice until the shooter either again throws the point number of the dice which thereby makes a made point and allows the shooter to again throw the dice for a repeat come out, or throws a 7 of the dice resulting in a sevening out and the shooter forfeiting throwing of the dice; an improvement thereto comprising a method for playing a proposition bet for the game of Craps, said method comprising the steps of:

predetermining a schedule of a pay-out table for the proposition bet;

at least one player placing a wager indication of the proposition bet prior to a shooter's initial come out;

accumulating made points responsive to outcomes of the shooter's dice throws, said made points being made when a number of the dice from the number group 4, 5, 6, 8, 9 and 10 is the outcome of any two of the shooter's dice throws prior to a sevening out, and wherein repetition of a number of any previously made point is ignored, comprising the steps of:

establishing a first point number if any of the shooter's dice throw outcomes is a number $N_1$ equal to any one of a 4, 5, 6, 8, 9, and 10 prior to sevening out;

making a first made point if thereafter any of the shooter dice throw outcomes is again the number $N_1$ prior to sevening out, wherein after said step of making a first made point, providing a first indicator indicative of the first made point having been made;

establishing a second point number if any of the shooter's dice throw outcomes is a number $N_2$ equal to any one of a 4, 5, 6, 8, 9, and 10 and $N_2 \neq N_1$ prior to sevening out;

making a second made point if thereafter any of the shooter dice throw outcomes is again the number $N_2$ prior to sevening out, wherein after said step of making a second made point, providing a second indicator indicative of the second made point having been made;

establishing a third point number if any of the shooter's dice throw outcomes is any one of a 4, 5, 6, 8, 9, and 10 and $N_3 \neq N_1 \neq N_2$ prior to sevening out;

making a third made point if thereafter any of the shooter dice throw outcomes is again the number $N_3$ prior to sevening out, wherein after said step of making a third made point, providing a third indicator indicative of the third made point having been made establishing a fourth point number if any of the shooter's dice throw outcomes is any one of a 4, 5, 6, 8, 9, and 10 and $N_4 \neq N_1 \neq N_2 \neq N_3$ prior to sevening out;

making a fourth point if thereafter any of the shooter dice throw outcomes is again the number $N_4$ prior to sevening out, wherein after said step of making a fourth made point, providing a fourth indicator indicative of the fourth made point having been made;

establishing a fifth point number if any of the shooter's dice throw outcomes is a number $N_5$ equal to any one of a 4, 5, 6, 8, 9, and 10 and $N_5 \neq N_1 \neq N_2 \neq N_3 \neq N_4$ prior to sevening out;

making a fifth made point if thereafter any of the shooter dice throw outcomes is again the number $N_1$ prior to sevening out wherein after said step of making a fifth made point, providing a fifth indicator indicative of the fifth made point having been made;

establishing a sixth point number if any of the shooter's dice throw outcomes is a number $N_6$ equal to any one of a 4, 5, 6, 8, 9, and 10 and $N_6 \neq N_1 \neq N_2 \neq N_3 \neq N_4 \neq N_5$ prior to sevening making a sixth made point if thereafter any of the shooter dice throw outcomes is again the number $N_6$ prior to sevening out, wherein after said step of making a sixth made point, providing a sixth indicator indicative of the sixth made point having been made; and winning a pay-out based upon the made points accumulated and the schedule.

16. The method of claim 15, wherein:

said step of providing a first indicator comprises placing a first point marker at the number $N_1$ of the point number area of the lay-out;

said step of providing a second indicator comprises placing a second point marker at the number $N_2$ of the point number area of the lay-out;

said step of providing a third indicator comprises placing a third point marker at the number $N_3$ of the point number area of the lay-out;

said step of providing a fourth indicator comprises placing a fourth point marker at the number $N_4$ of the point number area of the lay-out;

said step of providing a fifth indicator comprises placing a fifth point marker at the number $N_5$ of the point number area of the lay-out; and said step of providing a sixth indicator comprises placing a sixth point marker at the number $N_6$ of the point number area of the lay-out.

17. The method of claim 16, wherein the lay-out further includes indicia of a player betting area and a wager area corresponding to the player betting area, further comprising the steps of:

the at least one player placing the wager indication of the proposition bet at the player betting area of the lay-out; and a dealer placing the wager indication at the corresponding wager area of the lay-out.

18. The method of claim 15, wherein the lay-out further includes indicia of a player betting area and a wager area corresponding to the player betting area, further comprising the steps of:

the at least one player placing the wager indication of the proposition bet at the player betting area of the lay-out; and a dealer placing the wager indication at the corresponding wager area of the lay-out.

* * * * *

UNITED STATES PATENT AND TRADEMARK OFFICE

CERTIFICATE OF CORRECTION

PATENT NO. : 6,655,689 B1
DATED : December 2, 2003
INVENTOR(S) : Perry B. Stasi

It is certified that error appears in the above-identified patent and that said Letters Patent is hereby corrected as shown below:

Column 4,
Lines 43 and 56, “chip(s) 120” is deleted and replaced by -- chips 122 --.
Line 46, “chips 120” is deleted and replaced by -- chips 122 --.
Line 59, “wagers 122” is deleted and replaced by -- wagers 120 --.

Column 5,
Line 58, “anyone” is deleted and replaced by -- any one --.

Column 6,
Line 62, “made,” is deleted and replaced by -- made. --.

Column 11,
Line 56, “made,” is deleted and replaced by -- made; --.

Column 12,
Line 16, “sevening” is deleted and replaced by -- sevening out; and --.

Signed and Sealed this

Twenty-fifth Day of May, 2004

JON W. DUDAS
*Acting Director of the United States Patent and Trademark Office*